US008584498B2

(12) United States Patent
Yamane

(10) Patent No.: US 8,584,498 B2
(45) Date of Patent: Nov. 19, 2013

(54) MANDREL MILL AND METHOD FOR MANUFACTURING SEAMLESS PIPE OR TUBE

(75) Inventor: Akihito Yamane, Osaka (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 673 days.

(21) Appl. No.: 12/602,258

(22) PCT Filed: Jan. 8, 2008

(86) PCT No.: PCT/JP2008/050050

§ 371 (c)(1), (2), (4) Date: Jun. 11, 2010

(87) PCT Pub. No.: WO2008/146493

PCT Pub. Date: Dec. 4, 2008

(65) Prior Publication Data

US 2010/0251792 A1 Oct. 7, 2010

(30) Foreign Application Priority Data

May 31, 2007 (JP) ..... 2007-145401

(51) Int. Cl.
*B21B 1/08* (2006.01)

(52) U.S. Cl.
USPC ..... 72/199; 72/224; 72/235; 72/96; 72/98; 72/100; 72/208; 72/209; 72/225; 72/225.2; 72/9.2; 72/11.6; 72/11.8; 72/83; 492/1

(58) Field of Classification Search
USPC ..... 492/1; 72/8.83, 9.2, 11.6, 1, 11.8, 96, 72/100, 208, 224, 235, 209, 225.2
See application file for complete search history.

(56) References Cited

U.S. PATENT DOCUMENTS

| | | | | |
|---|---|---|---|---|
| 3,842,635 A | | 10/1974 | Bibighaus | |
| 4,289,011 A | * | 9/1981 | Yoshiwara et al. | 72/208 |
| 5,533,370 A | * | 7/1996 | Kuroda et al. | 72/12.5 |

FOREIGN PATENT DOCUMENTS

| | | |
|---|---|---|
| JP | 60-106603 | 6/1985 |
| JP | 5-50115 | 3/1993 |
| JP | 07-214109 | 8/1995 |
| JP | 09-201605 | 8/1997 |
| JP | 2002-35810 | 2/2002 |
| JP | 2005-111518 | 4/2005 |

* cited by examiner

*Primary Examiner* — Dana Ross
*Assistant Examiner* — Mohammad Nourbakhsh
(74) *Attorney, Agent, or Firm* — Clark & Brody

(57) ABSTRACT

The present invention provides a mandrel mill and the like that is capable of not only enhancing the elongation ratio of the pipe or tube, but also suppressing a pinhole defect from occurring. The first means of the present invention provides a mandrel mill comprising a plurality of rolling stands in which two grooved rolls R11, R12 are disposed, respectively, the mandrel mill being characterized in that the roll diameter ratio for the first rolling stand and the second rolling stand is set at a value of 4.6 or over. The second means of the present invention provides a mandrel mill comprising a plurality of rolling stands in which three grooved rolls R21, R22 and R23 are disposed, respectively, the mandrel mill being characterized in that the roll diameter ratio for the first rolling stand and the second rolling stand is set at a value of 2.8 or over.

2 Claims, 2 Drawing Sheets

MANDREL MILL AND METHOD FOR MANUFACTURING SEAMLESS PIPE OR TUBE

TECHNICAL FIELD

The present invention relates to a mandrel mill and a method for manufacturing a seamless pipe or tube using the same, and particularly relates to a mandrel mill that is capable of not only enhancing a elongation ratio of a pipe or tube, but also suppressing occurrence of a pinhole defect and a method for manufacturing the seamless pipe or tube using the same.

BACKGROUND ART

As a mandrel mill, which is a piece of equipment for manufacturing a seamless pipe or tube, there have been conventionally used a 2-roll type mandrel mill in which two grooved rolls opposed are disposed in each rolling stand, and between adjacent rolling stands, the rolling directions of the grooved rolls are alternately arranged, being 90° shifted, and also a 3-roll type mandrel mill in which three grooved rolls are disposed in each rolling stand such that the angle formed by the rolling directions of the grooved rolls is 120°, and between adjacent rolling stands, the rolling directions of the grooved rolls are alternately arranged, being 60° shifted. Hereinafter, "pipe or tube" is referred to as "pipe" when deemed appropriate.

Herein, in order to enhance the efficiency of manufacturing a seamless pipe, it is desirable that the elongation ratio of a pipe for a mandrel mill (i.e., the ratio of wall thickness of the pipe on the inlet side of the mandrel mill to that on the outlet side thereof) be enhanced as much as possible. This is because, if the elongation ratio of the pipe is enhanced, a pipe with a longer length can be obtained by drawing and rolling, and thus more product stocks can be obtained in one step of drawing and rolling.

In order to enhance the elongation ratio of the pipe for a mandrel mill, it can be conceived, for example, that the wall thickness rolling reduction rate for each of the rolling stands (especially for the upstream rolling stands) is set at a high value. However, if the wall thickness rolling reduction rate is set at too high a value, there arises a possibility that a through-hole called a pinhole defect occurs in a portion of the pipe that is opposed to the flange of the grooved roll, resulting from such a cause as the flow (metal flow) of the pipe material which is rolled at the groove bottom of the grooved roll being not sufficiently spread to the flange side of the grooved roll. Alternatively, for enhancing the elongation ratio of the pipe, it can be conceived to increase the number of rolling stands without setting the wall thickness rolling reduction rate for each of the rolling stands at too high a value. However, increasing the number of rolling stands will increase the equipment cost in proportion, and also require increased manpower for maintenance, thus a practical number of rolling stands is said to be about 5 to 8. Thus, with the conventional mandrel mill, for example, a mandrel mill provided with five rolling stands, the elongation ratio of the pipe is generally held to under 4. Therefore, a mandrel mill which allows the elongation ratio of the pipe to be further enhanced for increasing the efficiency of manufacturing a seamless pipe has been demanded.

DISCLOSURE OF THE INVENTION

The present invention has been made in view of such a problem with the prior art, and it is a subject of the present invention to provide a mandrel mill that is capable of not only enhancing the elongation ratio of the pipe, but also suppressing a pinhole defect from occurring and a method for manufacturing a seamless pipe using the same.

In order to solve the aforementioned subject, the present inventor has made a keen study, and has found the fact that, if the roll diameter for the first rolling stand and the second rolling stand is increased to a predetermined value or over (accordingly, if the roll diameter ratio is increased to a predetermined value or over), not only the elongation ratio of the pipe or tube can be enhanced, but also occurrence of a pinhole defect can be suppressed. The present invention has been completed on the basis of such a new finding of the present inventor.

Namely, the first means of the present invention provides a mandrel mill comprising a plurality of rolling stands in which two grooved rolls are disposed, respectively, the mandrel mill being characterized in that the roll diameter ratio for the first rolling stand and the second rolling stand is set at a value of 4.6 or over.

The "first rolling stand" in the first means refers to a rolling stand which is disposed first when counted from the inlet side of the mandrel mill. Likewise, the "second rolling stand" in the first means refers to a rolling stand which is disposed second when counted from the inlet side of the mandrel mill. In addition, the "roll diameter ratio" for the first means refers to a ratio expressed by $D_R/D_C$, where $D_R$ is the roll diameter (the smallest roll diameter) at the groove bottom of each grooved roll which is disposed in the rolling stand, and $D_C$ is the distance between the groove bottoms of the grooved rolls.

Also, the second means of the present invention provides a mandrel mill comprising a plurality of rolling stands in which three grooved rolls are disposed, respectively, the mandrel mill being characterized in that the roll diameter ratio for the first rolling stand and the second rolling stand is set at a value of 2.8 or over.

The meanings of the "first rolling stand" and the "second rolling stand" for the second means are the same as those for the first means that are described above. In addition, the "roll diameter ratio" for the second means refers to a ratio expressed by $D_R/D_C$, where $D_R$ is the roll diameter (the smallest roll diameter) at the groove bottom of each grooved roll which is disposed in the rolling stand, and $D_C/2$ is the distance between the groove bottom of each grooved roll and the pass center.

Further, in order to solve the aforementioned subject, the present invention provides a method for manufacturing a seamless pipe or tube, the method being characterized by comprising the step of drawing and rolling a pipe or tube using the mandrel mill according to the first means or the second means.

According to the present invention, not only the elongation ratio of the pipe or tube can be enhanced, but also occurrence of a pinhole defect can be suppressed. Therefore, the efficiency of manufacturing a seamless pipe or tube can be increased without causing poor-quality rolling.

BEST MODE FOR CARRYING OUT THE INVENTION

Hereinbelow, embodiments of the present invention will be explained with appropriate reference to the attached drawings.

First Embodiment

Figure 1A:
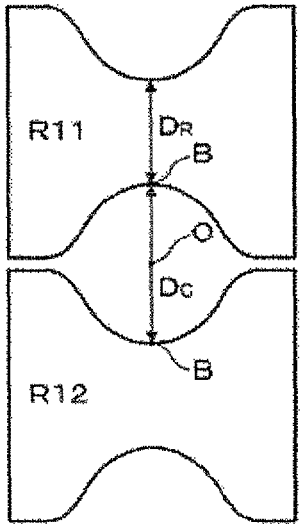
FIG. 1A is a longitudinal sectional view illustrating a schematic configuration of a rolling stand constituting a two-roll type mandrel mill according to a first embodiment of the present invention.

FIG. 1A is a longitudinal sectional view illustrating a schematic configuration of a rolling stand constituting a two-roll type mandrel mill according to a first embodiment of the present invention. As shown in FIG. 1A, a mandrel mill according to the present embodiment comprises a plurality of rolling stands in which two grooved rolls R11 and R12 are disposed. And, the mandrel mill is characterized in that the roll diameter ratio $D_R/D_C$ for the first rolling stand and the second rolling stand is set at a value of 4.6 or over.

In other words, as shown in FIG. 1A, if the roll diameter (the smallest roll diameter) at the groove bottom B of each grooved roll R11, R12 which is disposed in the first rolling stand is $D_R$, and the distance between the groove bottoms B of the grooved rolls R11, R12 is $D_C$, the roll diameter ratio expressed by $D_R/D_C$ is set at 4.6 or over. This description is also applicable to the second rolling stand. For the other rolling stands (for example, a third rolling stand to a fifth rolling stand in case where the mandrel mill according to the present embodiment comprises five rolling stands in total), there is no need for setting the roll diameter ratio at the above-mentioned value, but the roll diameter ratio may be set at a value which has been conventionally used (for example, 3 or under). Hereinbelow, the reason why the roll diameter ratio $D_R/D_C$ for the first rolling stand and the second rolling stand is set at a value of 4.6 or over will be explained with reference to FIG. 1B.

Figure 1B:
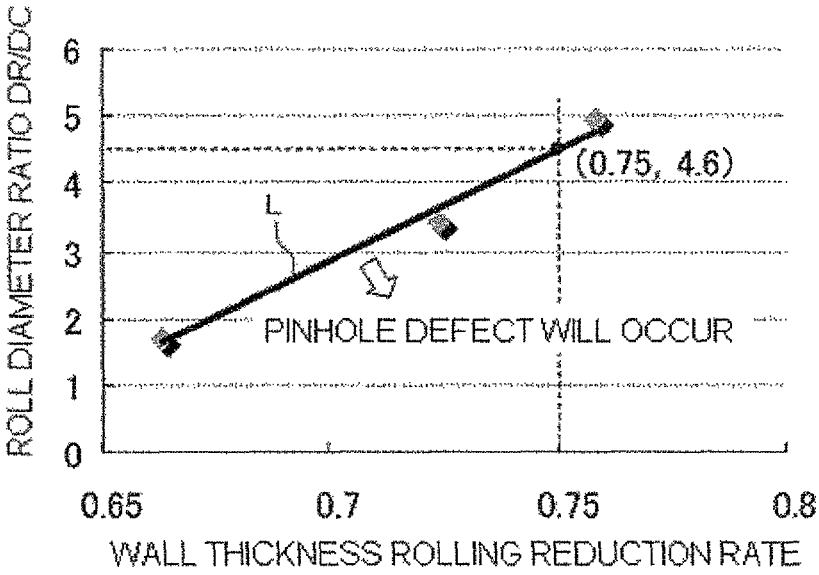
FIG. 1B is a graph obtained by plotting the lower limit values of roll diameter ratio with which no pinhole defects occurred in a pipe when drawing and rolling thereof was performed with the wall thickness rolling reduction rate of the pipe and the roll diameter ratio being set at various values in the first rolling stand and the second rolling stand of the mandrel mill according to the first embodiment of the present invention.

FIG. 1B is a graph obtained by plotting the lower limit values of roll diameter ratio with which no pinhole defects occurred in a pipe when drawing and rolling thereof was performed with the wall thickness rolling reduction rate of the pipe and the roll diameter ratio being set at various values in the first rolling stand and the second rolling stand of the mandrel mill according to the first embodiment. In other words, the graph shown in FIG. 1B indicates that, if the wall thickness rolling reduction rate and the roll diameter ratio are set at a value in the region under an approximate straight line L shown in FIG. 1B, a pinhole defect will occur in the pipe, while, if the wall thickness rolling reduction rate and the roll diameter ratio are set at a value in the region above the approximate straight line L, no pinhole defect will occur in the pipe. The wall thickness rolling reduction rate, which is represented by the abscissa in FIG. 1B, is a rate defined by the following formula (1):

$$\text{Wall thickness rolling reduction rate}=(t_{i1}-t_{o2})/t_{i1}=1-t_{o2}/t_{i1} \quad (1)$$

where $t_{i1}$ is the wall thickness of the pipe on the inlet side of the first rolling stand and $t_{o2}$ is the wall thickness of the pipe on the outlet side of the second rolling stand.

Herein, $t_{i1}/t_{o2}$, which is a reciprocal of $t_{o2}/t_{i1}$ given on the right side of the above formula (1), provides a value corresponding to the elongation ratio of the pipe for the first rolling stand and the second rolling stand. If this $t_{i1}/t_{o2}$ is set at a value of at least 4, the value of the elongation ratio of the pipe (the ratio of wall thickness of the pipe on the inlet side of mandrel mill to that on the outlet side thereof) for the entire mandrel mill will be 4 or over, which is larger than conventional. When $t_{i1}/t_{o2}=4$, the wall thickness rolling reduction rate defined by the above formula (1) will be 0.75. And, as can be seen from FIG. 1B, when the wall thickness rolling reduction rate=0.75, setting the roll diameter ratio $D_R/D_C$ at a value of 4.6 or over will allow occurrence of a pinhole defect to be suppressed. In other words, if the roll diameter ratio $D_R/D_C$ is set at a value of 4.6 or over, not only the elongation ratio of the pipe for the first rolling stand and the second rolling stand can be enhanced to 4 (accordingly, the elongation ratio of the pipe for the entire mandrel mill can be enhanced to a value of 4 or over, which is larger than conventional), but also occurrence of a pinhole defect can be suppressed.

From the reason as described above, the roll diameter ratio $D_R/D_C$ for the first rolling stand and the second rolling stand of the mandrel mill according to the present embodiment is set at a value of 4.6 or over. Thereby, with the mandrel mill according to the present embodiment, not only the elongation ratio of the pipe can be enhanced, but also occurrence of a pinhole defect can be suppressed. With the roll diameter ratio $D_R/D_C$ being increased (the roll diameter $D_R$ being increased), the length of contact made between the pipe which is being subjected to drawing and rolling and the grooved roll R11, R12 (the contact length of the pipe along the direction of axis thereof) is increased. It can therefore be considered that, even if the elongation ratio (the wall thickness rolling reduction rate) is set at a high value, the flow (metal flow) of the pipe material is sufficiently spread to the flange side of the grooved roll R11, R12 during the drawing and rolling, whereby occurrence of a pinhole defect can be suppressed.

Second Embodiment

Figure 2A:
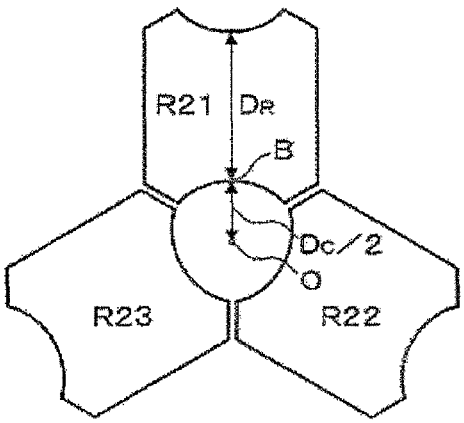
FIG. 2A is a longitudinal sectional view illustrating a schematic configuration of a rolling stand constituting a three-roll type mandrel mill according to a second embodiment of the present invention.

FIG. 2A is a longitudinal sectional view illustrating a schematic configuration of a rolling stand constituting a three-roll type mandrel mill according to a second embodiment of the present invention. As shown in FIG. 2A, a mandrel mill according to the present embodiment comprises a plurality of rolling stands in which three grooved rolls R21 R22 and R23 are disposed. And, the mandrel mill is characterized in that the roll diameter ratio $D_R/D_C$ for the first rolling stand and the second rolling stand is set at a value of 2.8 or over.

In other words, as shown in FIG. 2A, if the roll diameter (the smallest roll diameter) at the groove bottom B of each grooved roll R21 to R23 which is disposed in the first rolling stand is $D_R$, and the distance between the groove bottom B of each grooved roll R21 to R23 and the pass center O (the pass line center for the pipe as the workpiece) is $D_C/2$, the roll diameter ratio expressed by $D_R/D_C$ is set at 2.8 or over. This description is also applicable to the second rolling stand. For the other rolling stands (for example, a third rolling stand to a fifth rolling stand in case where the mandrel mill according to the present embodiment comprises five rolling stands in total), there is no need for setting the roll diameter ratio at the above-mentioned value, but the roll diameter ratio may be set at a value which has been conventionally used (for example, 3 or under). Hereinbelow, the reason why the roll diameter ratio $D_R/D_C$ for the first rolling stand and the second rolling stand is set at a value of 2.8 or over will be explained with reference to FIG. 2B.

Figure 2B:
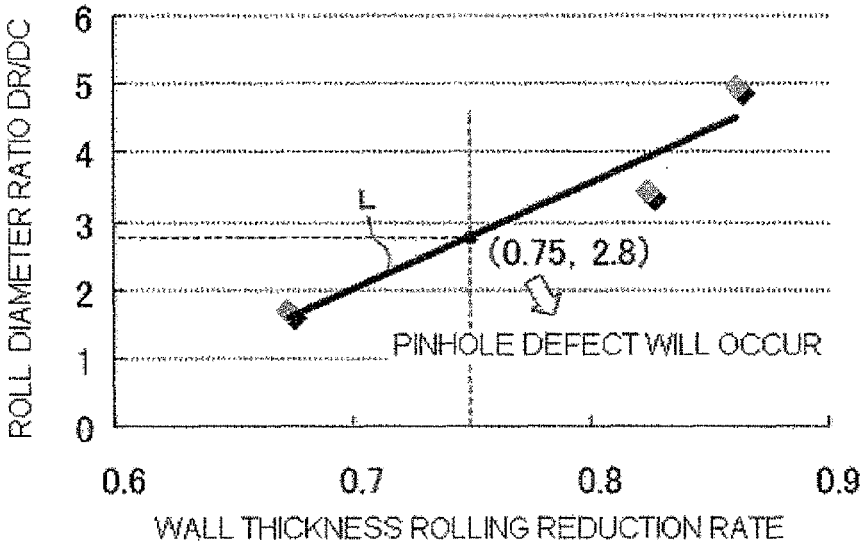
FIG. 2B is a graph obtained by plotting the lower limit values of roll diameter ratio with which no pinhole defects occurred in a pipe when drawing and rolling thereof was performed with the wall thickness rolling reduction rate of the pipe and the roll diameter ratio being set at various values in the first rolling stand and the second rolling stand of the mandrel mill according to the second embodiment of the present invention.

FIG. 2B is a graph obtained by plotting the lower limit values of roll diameter ratio with which no pinhole defects occurred in a pipe when drawing and rolling thereof was performed with the wall thickness rolling reduction rate of the pipe and the roll diameter ratio being set at various values in the first rolling stand and the second rolling stand of the mandrel mill according to the second embodiment. In other words, the graph shown in FIG. 2B indicates that, if the wall thickness rolling reduction rate and the roll diameter ratio are set at a value in the region under an approximate straight line L shown in FIG. 2B, a pinhole defect will occur in the pipe, while, if the wall thickness rolling reduction rate and the roll diameter ratio are set at a value in the region above the approximate straight line L, no pinhole defect will occur in the pipe. The wall thickness rolling reduction rate, which is represented by the abscissa in FIG. 2B, is a rate defined by the above formula (1), as the first embodiment.

And, as can be seen from FIG. 2B, when the wall thickness rolling reduction rate=0.75, setting the roll diameter ratio $D_R/D_C$ at a value of 2.8 or over will allow occurrence of a pinhole defect to be suppressed. In other words, if the roll diameter ratio $D_R/D_C$ is set at a value of 2.8 or over, not only the elongation ratio of the pipe for the first rolling stand and the second rolling stand can be enhanced to 4 (accordingly, the elongation ratio of the pipe for the entire mandrel mill can be enhanced to a value of 4 or over, which is larger than conventional), but also occurrence of a pinhole defect can be suppressed.

From the reason as described above, the roll diameter ratio $D_R/D_C$ for the first rolling stand and the second rolling stand of the mandrel mill according to the present embodiment is set at a value of 2.8 or over. Thereby, with the mandrel mill according to the present embodiment, not only the elongation ratio of the pipe can be enhanced, but also occurrence of a pinhole defect can be suppressed. With the roll diameter ratio $D_R/D_C$ being increased (the roll diameter $D_R$ being increased), the length of contact made between the pipe which is being subjected to drawing and rolling and the grooved roll R21, R22 and R23 (the contact length of the pipe along the direction of axis thereof) is increased. It can therefore be considered that, even if the elongation ratio (the wall thickness rolling reduction rate) is set at a high value, the flow (metal flow) of the pipe material is sufficiently spread to the flange side of the grooved roll R21, R22 and R23 during the drawing and rolling, whereby occurrence of a pinhole defect can be suppressed.

With the mandrel mill according to the first embodiment and the second embodiment described above, if the roll diameter ratio $D_R/D_C$ for the first rolling stand and the second rolling stand is set at too high a value (the roll diameter $D_R$ is set at too high a value), grooved rolls having a large diameter will be required, resulting in an increased equipment cost. In addition, the distance between rolling stands (the distance from the first rolling stand to the second rolling stand and that from the second rolling stand to the third rolling stand) will be increased, resulting in the length of the non-steady portion of the pipe end (the portion of the pipe end that is subjected to drawing and rolling with both pipe ends being not constrained by the grooved rolls) being increased, which may deteriorate the quality of the pipe. Further, with the distance between rolling stands being increased, a continuous length of mandrel bar will be required, resulting in the equipment cost being increased. In order to avoid the above-mentioned undesirable effects, it is preferable that the roll diameter ratio $D_R/D_C$ for the first rolling stand and the second rolling stand be set at a value as close to the lower limit value as possible.

The invention claimed is:

1. A method for manufacturing a seamless pipe or tube comprising the step of drawing and rolling a pipe or tube using a mandrel mill that comprises a plurality of rolling stands in which two grooved rolls are disposed, respectively, the method being characterized by drawing and rolling a pipe or tube, setting the roll diameter ratio for the first rolling stand and the second rolling stand at a value of 4.6 or over when the wall thickness rolling reduction rate for the first rolling stand and the second rolling stand is 0.75 or under, wherein the wall thickness rolling reduction rate for the first rolling stand and the second rolling stand refers to a rate defined by $(t_{i1}-t_{o2})/t_{i1}$ where $t_{i1}$ is the wall thickness of the pipe or tube on the inlet side of the first rolling stand and $t_{o2}$ is the wall thickness of the pipe or tube on the outlet side of the second rolling stand.

2. A method for manufacturing a seamless pipe or tube comprising the step of drawing and rolling a pipe or tube using a mandrel mill that comprises a plurality of rolling stands in which three grooved rolls are disposed, respectively, the method being characterized by drawing and rolling a pipe or tube, setting the roll diameter ratio for the first rolling stand and the second rolling stand at a value of 2.8 or over when the wall thickness rolling reduction rate for the first rolling stand and the second rolling stand is 0.75 or under, wherein the wall thickness rolling reduction rate for the first rolling stand and the second rolling stand refers to a rate defined by $(t_{i1}-t_{o2})/t_{i1}$ where $t_{i1}$ is the wall thickness of the pipe or tube on the inlet side of the first rolling stand and $t_{o2}$ is the wall thickness of the pipe or tube on the outlet side of the second rolling stand.

* * * * *

UNITED STATES PATENT AND TRADEMARK OFFICE

CERTIFICATE OF CORRECTION

PATENT NO. : 8,584,498 B2
APPLICATION NO. : 12/602258
DATED : November 19, 2013
INVENTOR(S) : Akihito Yamane It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 866 days.

Signed and Sealed this
Twenty-second Day of September, 2015

Michelle K. Lee

Michelle K. Lee
*Director of the United States Patent and Trademark Office*